US008534214B1

(12) United States Patent
Gasper

(10) Patent No.: US 8,534,214 B1
(45) **Date of Patent: *Sep. 17, 2013**

(54) SURF WAKE SYSTEM AND METHOD FOR A WATERCRAFT

(71) Applicant: Malibu Boats, LLC, Merced, CA (US)

(72) Inventor: Daniel Lee Gasper, Atwater, CA (US)

(73) Assignee: Malibu Boats LLC, Merced, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/830,274

(22) Filed: Mar. 14, 2013

Related U.S. Application Data

(63) Continuation of application No. PCT/US2012/055788, filed on Sep. 17, 2012.

(60) Provisional application No. 61/535,438, filed on Sep. 16, 2011.

(51) Int. Cl.
*B63B 1/22* (2006.01)

(52) U.S. Cl.
USPC ..... 114/284

(58) Field of Classification Search
USPC ..... 114/271, 274–282, 284, 285
See application file for complete search history.

(56) References Cited

U.S. PATENT DOCUMENTS 3,294,052 A * 12/1966 Jones ..... 114/282
5,058,520 A 10/1991 Fahrney
5,385,110 A 1/1995 Bennett et al.
5,549,071 A 8/1996 Pigeon et al.
5,860,384 A 1/1999 Castillo
5,860,766 A 1/1999 Lochtefeld et al.
5,911,190 A 6/1999 Lochtefeld et al.
6,012,408 A 1/2000 Castillo
6,105,527 A 8/2000 Lochtefeld et al.
6,213,044 B1 4/2001 Rodgers et al.
6,874,441 B2 * 4/2005 Pigeon ..... 114/285
6,935,263 B1 * 8/2005 Bandyopadhyay ..... 114/284
6,941,884 B2 * 9/2005 Moore ..... 114/284
7,063,031 B2 6/2006 Earl, Jr. et al.
7,140,318 B1 * 11/2006 Gasper ..... 114/282
7,246,565 B2 7/2007 Snook et al.
7,252,047 B1 8/2007 Baucom, Jr.
7,311,058 B1 12/2007 Brooks et al.
7,434,531 B1 * 10/2008 Zsido et al. ..... 114/284
7,467,596 B2 12/2008 Salmon
7,707,956 B2 5/2010 Moore (Continued)

OTHER PUBLICATIONS

U.S. Appl. No. 13/830,356, Gasper et al., filed Mar. 14, 2013.*

(Continued)

*Primary Examiner* — Daniel Venne
(74) *Attorney, Agent, or Firm* — Knobbe, Martens, Olson & Bear LLP

(57) ABSTRACT

A wake modifying system for modifying a wake produced by a watercraft traveling through water may include a rudder pivotally mounted to the watercraft for steering the watercraft, a fin pivotally mounted to the watercraft substantially along a centerline of the watercraft and forward the rudder, wherein the fin pivots about an upright axis to modify the wake produced by the watercraft traveling through the water, an actuator mounted within the watercraft and operably coupled to the fin for pivoting the fin relative to the centerline, and a controller mounted on the watercraft allowing an operator to control the actuator and selectively pivot the fin to a desired angle θd relative to the centerline.

20 Claims, 6 Drawing Sheets

(56) References Cited

U.S. PATENT DOCUMENTS

| | | | | |
|---|---|---|---|---|
| 7,780,490 | B2 | 8/2010 | Lundgren | |
| 8,191,493 | B2 * | 6/2012 | Baywol | 114/285 |
| 2004/0261684 | A1 | 12/2004 | Pigeon | |
| 2005/0155540 | A1 * | 7/2005 | Moore | 114/219 |
| 2006/0054067 | A1 | 3/2006 | Hoberman et al. | |
| 2007/0078575 | A1 * | 4/2007 | Wilson et al. | 701/21 |
| 2007/0125287 | A1 | 6/2007 | Walker | |
| 2008/0271660 | A1 | 11/2008 | Zsido et al. | |
| 2010/0251952 | A1 | 10/2010 | Baywol | |

OTHER PUBLICATIONS

U.S. Appl. No. 13/830,799, Gasper et al., filed Mar. 14, 2013.*
U.S. Appl. No. 13/545,969, filed Jul. 10, 2013, Gasper et al.
U.S. Appl. No. 13/749,500, filed Jan. 24, 2013, Gasper et al.
U.S. Appl. No. 13/830,799, filed Mar. 14, 2013, Gasper et al.
U.S. Appl. No. 13/830,356, filed Mar. 14, 2013, Gasper et al.
MasterCraft Surf Tab—Screenshots taken from video uploaded on May 26, 2010 at http://www.youtube.com/watch?v=b1Q_MLR031M.
Tige Convex VX—Screenshots taken from video uploaded on Oct. 10, 2012 at http://www.youtube.com/watch?v=jx5QXC-dU9w.
Centurion Wake Plate—Website dated Aug. 27, 2011—http://www.centurionboats.com/features-and-options/adjustable-wake-plate.html.
Nautique Surf System—Released Jan. 3, 2013—Website printout from http://www.nautique.com/models/nautique-surf-system.
International Search Report dated Dec. 6, 2012 for PCT/US2012/055788.
International Search Report dated Jan. 25, 2013 for PCT/US2012/064504.

* cited by examiner

SURF WAKE SYSTEM AND METHOD FOR A WATERCRAFT

CROSS-REFERENCE TO RELATED APPLICATIONS

This application is a continuation of International Patent Application No. PCT/US2012/055788, with an international filing date of Sep. 17, 2012, and titled SURF WAKE SYSTEM AND METHOD FOR A WATERCRAFT, which designates the United States, and which claims the benefit under 35 U.S.C. §119(e) of U.S. Provisional Patent Application No. 61/535,438, filed on Sep. 16, 2011 and titled SURF WAKE SYSTEM AND METHOD FOR A WATERCRAFT. Each of the above-identified patent applications is hereby incorporated by reference in its entirety and is made a part of this specification for all that it discloses.

BACKGROUND

1. Field of the Disclosure

This invention relates, in general, to a surf wake system and method for a watercraft and more particularly to a wake modifying system for modifying a wake produced by a watercraft traveling through water and methods for their use.

2. Description of the Related Art

Generally, wake surfing is a water sport in which a surfer trails behind a ballasted wake boat at relatively slow speeds. Riders surf on an endless wave. The wake boats are specific wake boats with rear platforms and direct submerged drives so the propeller is under the boat.

In order to create wakes, owners of inboard boats place ballast, such as water, lead weights, cement, or other heavy objects in different sections of the boat in order to weight the boat down and create a larger wake. The weight may add a bias of weight toward the back corner of the boat that the rider is surfing on.

However, it takes trial and error to figure out where to put the ballast and how much to produce the best wave on your boat. For example, if a left surf wake is desired, one would position a significant amount of weight near the aft left corner of the boat. Positioning several hundred pounds of ballast (e.g., 600-800 lbs, or more) or several large men adjacent the desired corner may be necessary for creating a suitable surf wake. One will appreciate such imbalance generally leads to significant lean of the watercraft. For example, a lean of approximately 14° is often necessary when using conventional ballast systems in order to create a suitable surf wake. As one can imagine, such lean may have deleterious effects on both handling and passenger enjoyment.

The information disclosed in this Background of the Invention section is only for enhancement of understanding of the general background of the invention and should not be taken as an acknowledgement or any form of suggestion that this information forms the prior art already known to a person skilled in the art.

SUMMARY

Various aspects of the present invention are directed to a wake modifying system for modifying a wake produced by a watercraft traveling through water.

In various aspects of the present invention, the wake modifying system may include a rudder pivotally mounted to the watercraft for steering the watercraft, a fin pivotally mounted to the watercraft substantially along a centerline of the watercraft and forward the rudder, wherein the fin pivots about an upright axis to modify the wake produced by the watercraft traveling through the water, an actuator mounted within the watercraft and operably coupled to the fin for pivoting the fin relative to the centerline, and a controller mounted on the watercraft allowing an operator to control the actuator and selectively pivot the fin to a desired angle θd relative to the centerline.

The fin may be disposed along the centerline substantially adjacent a midline of the watercraft, wherein the fin includes a short portion extending in a direction from the upright axis and a long portion extending in another direction from the upright axis, and wherein the long portion may be longer than the short portion. A length ratio of the short portion and the long portion may be approximately 13. The short portion and the long portion have lengths of approximately 3.5 inches and approximately 8.5 inches, respectively.

The wake modifying system may further include another fin pivotally mounted to the watercraft substantially along the centerline of the watercraft and forward the fin, wherein the another fin pivots about another upright axis substantially parallel to the upright axis. Each of the fin and the another fin include short and long portions extending in opposing directions from the upright axis and the another upright axis, respectively. The short portion of both the fin and the another fin extend in a direction from the upright axis and the another upright axis, respectively. The long portion of both the fin and the another fin extend in another direction from the upright axis and the another upright axis, respectively, wherein the actuator may be operably coupled to both the fin and the another fin for pivoting the fins relative to the centerline in phase.

One end of the actuator may be affixed to the watercraft and another end thereof may be operably coupled to the fin by a link mechanism. One end of the actuator may be affixed to the watercraft and another end thereof may be operably coupled to the fin by a rack and pinion.

The controller may be configured to control the actuator to return the fin to approximately 0° relative to the centerline when a speed of the watercraft may be above a predetermined speed, wherein the predetermined speed may be approximately 10 miles per hour. Maximum value of the desired angle may be approximately 22°. The controller includes a touch screen allowing the operator to set the desired angle. The rudder may be pivoted in opposite direction of rotation direction of the fin.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION OF CERTAIN EMBODIMENTS

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
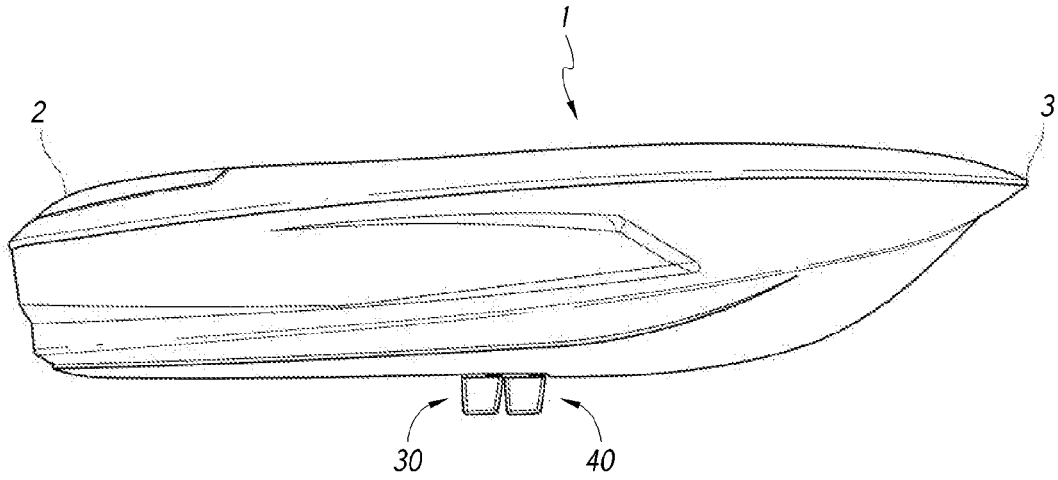
FIG. 1 is a side view of an exemplary surf wake system having adjustable surf fins according to the present invention.
Figure 2:
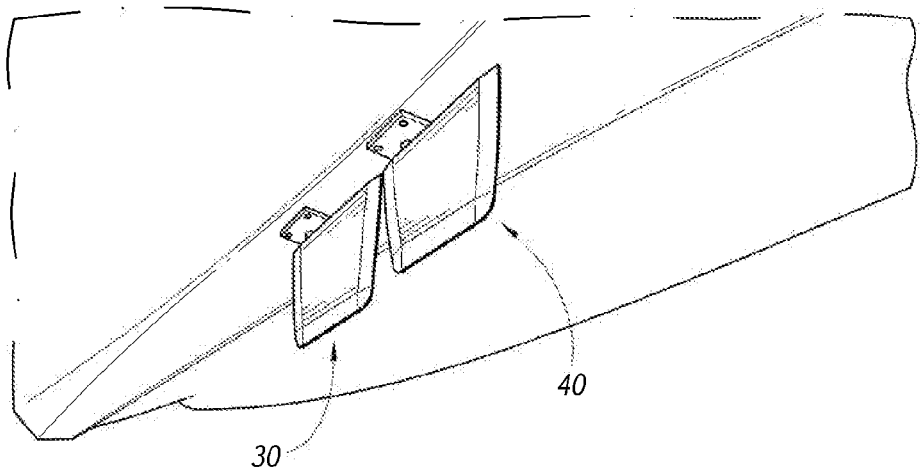
FIG. 2 is an enlarged perspective view of two fins of FIG. 1 aligned along a centerline.

Turning now to the drawings, wherein like components are designated by like reference numerals throughout the various figures, attention is directed to FIGS. 1 and 2, which illustrate a wake modifying system for modifying a wake produced by a watercraft 1 traveling through water. The system generally includes a rudder 5 pivotally mounted to the watercraft for steering the watercraft, one or more fins pivotally mounted to the watercraft substantially along a centerline 10 of the watercraft and forward the rudder 5. In the illustrated embodiment, the fin pivots about an upright axis thereof to modify the wake produced by the watercraft traveling through the water. One will appreciate that the axis may be substantially vertical, or somewhat inclined. The system also includes an actuator 50 mounted within the watercraft and operably coupled to the fin for pivoting the fin relative to centerline 10. A controller 60 is mounted on the watercraft allowing an operator to control actuator 50 to selectively pivot the fin to a desired angle θd relative to centerline 10.

In an exemplary embodiment of the present invention, the wake modifying system may include a single fin 30 or 40. Fin 30 or 40 may be disposed along centerline 10 substantially adjacent a midline 20 of the watercraft.

Centerline 10 is an imaginary line dividing the watercraft along a longitudinal direction substantially in equal ratio in a traverse direction of the watercraft. The midline 20 is an imaginary line dividing the watercraft along a traverse direction substantially in equal ratio in a longitudinal direction of the watercraft.

Figure 3:
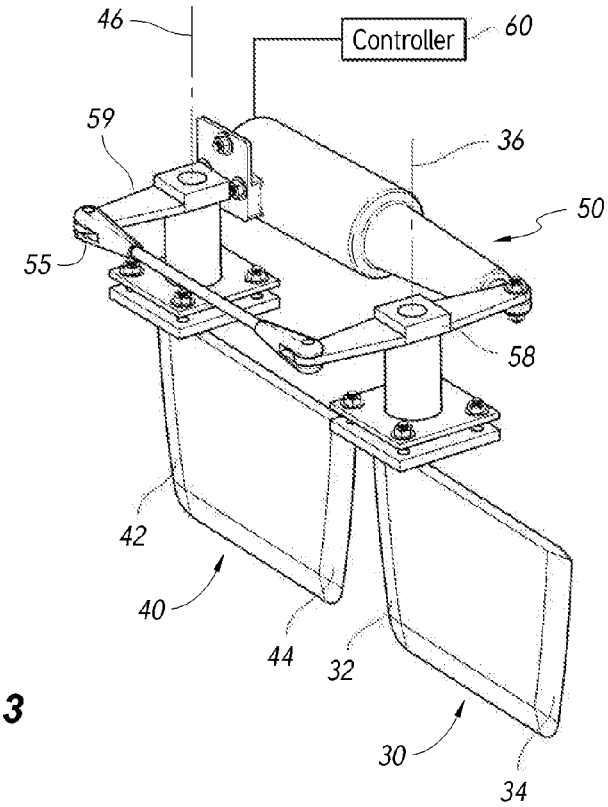
FIG. 3 is an enlarged schematic view of the actuator and the two fins of FIG. 2 aligned along a centerline of a watercraft.
Figure 4:
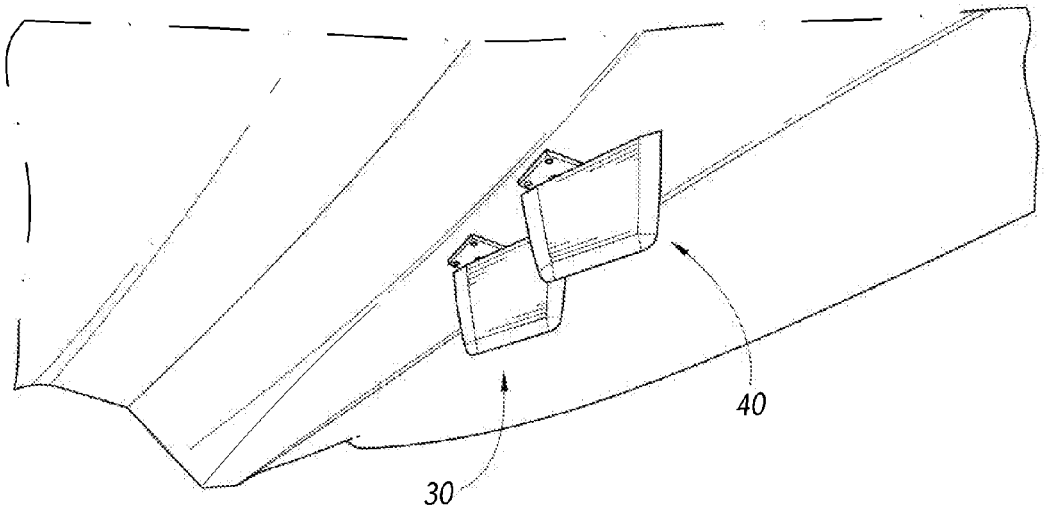
FIG. 4 is an enlarged perspective view of the two fins of FIG. 1 tilted with a predetermined angle with respect to a centerline of a watercraft.

As shown in FIG. 3, each of fin 30 or 40 may include a short portion 32, 42 extending in a direction from the upright axis 36 or 46 of fin 30 or 40 and a long portion 34, 44 thereof extending in another direction from the upright axis 36 or 46, wherein each short portion of fin 30 or 40 extends in opposing directions from the upright axis 36 or 46 respectively. One will appreciate that the forward portion of the fins may be longer or shorter than the rearward portion of the fins.

In various embodiments of the present invention, the length ratio of short portions 32, 42 and long portions 34, 44 may be approximately 1:3. In other embodiments, short portions 32, 42 and the long portions 34, 44 may have lengths of approximately 3.5 inches and approximately 8.5 inches, respectively. One will appreciate that the actual dimensions may vary.

The wake modifying system may further include an actuator 50 that is operably coupled to one or both fins 30 and 40 for pivoting the fins relative to centerline 10 in phase.

In various embodiments, the wake modifying system of the present invention may one, two, three or more fins. The fin(s) may be disposed between stern 2 and midline 20, or in various embodiments, forward the midline. The long portion 34 of fin 30 may be aligned toward stern 2 or toward bow 3 of the watercraft.

In other embodiments of the present invention, the wake modifying system may include only a fin 40 that is disposed between bow 3 and midline 20. The long portion 44 of fin 40 may be aligned toward stern 2 of the watercraft or toward bow 3 of the watercraft.

Fin 30 or 40 may be pivoted by a link mechanism, a rack and pinion mechanism, or other suitable means. Since operation of the actuator applied to a single fin is similar to that applied to a plurality of fins, the below explanation will be made primarily with reference to a wake modifying system having two fins. One will appreciate that one or more actuators may be provided to control one or more fins.

In addition, the plurality of fins may include two or more fins which that may be individually rotated, or cooperatively controlled to rotate the fins simultaneously, synchronously or asynchronously, and/or in-phase or out-of-phase.

Fins 30 and 40 may be pivotally mounted to the watercraft substantially along centerline 10 of the watercraft. Fins 30 and 40 may be substantially adjacent the midline 20 of the watercraft as shown in FIGS. 2-5. In various embodiments, one fin may be disposed between stern 2 and midline 20 while another fin may be disposed between bow 3 and midline 20.

Figure 6:
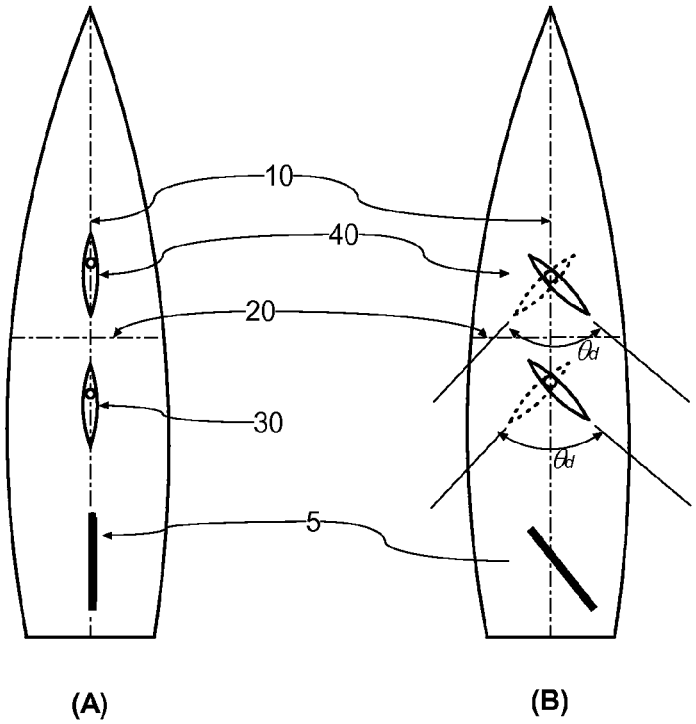
FIGS. 6(A) and 6(B) are schematic views illustrating two fins aligned along a center line of the watercraft and operation thereof, where long portions of the fins are oriented aft of a watercraft according to an exemplary embodiment of the present invention.

In various embodiments of the present invention, as shown in FIGS. 6(A) and 6(B), the long portions 34 and 44 of fins 30 and 40 may be disposed toward stern 2, that is, the long portions may extend aft. The long portions 34 and 44 of fins 30 and 40 may operate to move to the same side (i.e., left or right direction) with respect to centerline 10 as shown in FIG. 6(B). Accordingly, the long portions 34 and 44 of fins 30 and 40 may synchronously pivot to the left or right side of the center line 10.

However, while the long portions 34 and 44 of fins 30 and 40 may operate in one side, for instance, the right side of the watercraft with respect to centerline 10 as shown in FIG. 6(B), the watercraft may tend to rotate in a counterclockwise direction in the drawing. Accordingly, the rudder 5 may be actuated by controller 60 to rotate in a clockwise direction, as shown in the drawing, or in a counter clockwise direction.

Figure 7:
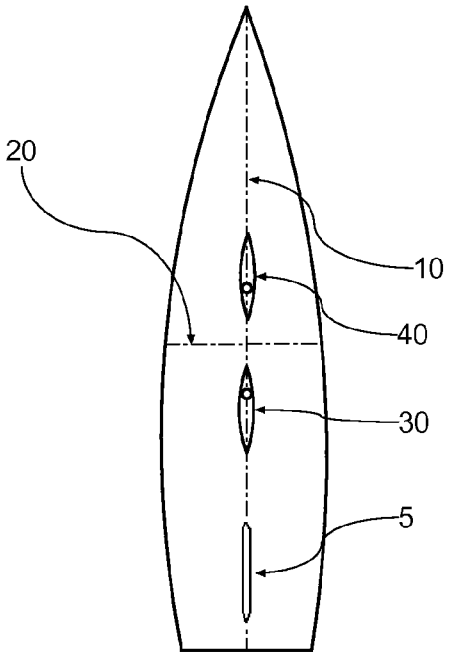
FIG. 7 is a schematic view illustrating two fins, wherein a long portion of a fin is oriented toward the bow and a long portion of another fin is oriented aft of a watercraft according to an exemplary embodiment of the present invention
Figure 8:
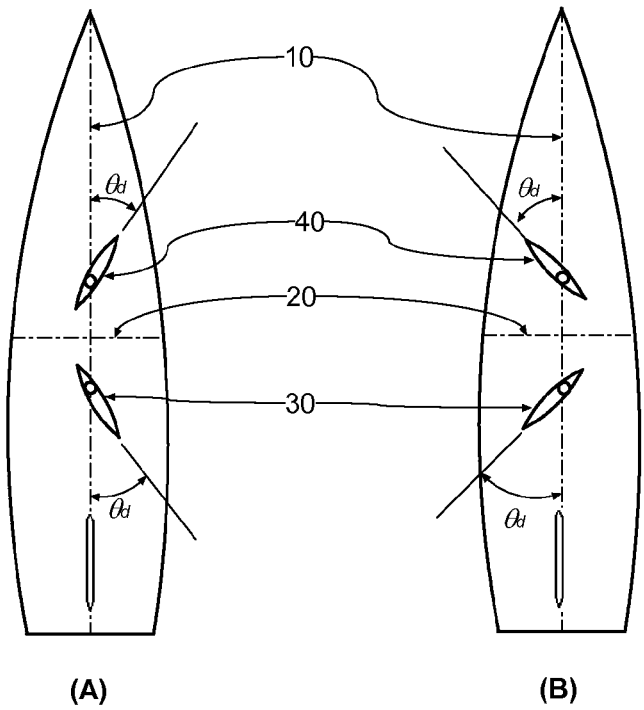
FIGS. 8(A) and 8(B) are schematic views illustrating two fins, wherein a long portion of a fin is oriented toward the bow and a long portion of another fin is oriented aft, and wherein each fin is controlled independently to be placed in the same side with respect to the centerline of a watercraft according to an exemplary embodiment of the present invention.
Figure 9:
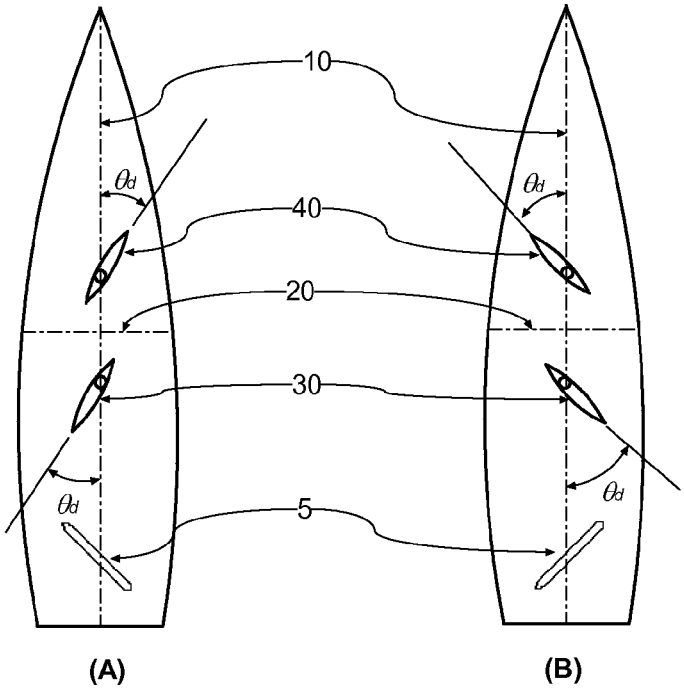
FIGS. 9(A) and 9(B) are schematic views illustrating two fins, wherein a long portion of a fin is oriented toward the bow and a long portion of another fin is oriented aft, and wherein each fin is controlled independently to be placed in the opposite side with respect to the centerline of a watercraft according to an exemplary embodiment of the present invention.

FIGS. 7-9 show another exemplary embodiment of the present invention in which a long portion 34 of fin 30 is aligned toward stern 2 and the long portion 44 of fin 40 is aligned toward the bow 2.

In this structure, long portions 34 and 44 of fins 30 and 40 may operate in the same side (i.e., left or right side) with respect to centerline 10 as shown in FIGS. 8(A) and 8(B). Accordingly, the long portions 34 and 44 of fins 30 and 40 may synchronously pivot in the left or right side of the center line 10 with a phase difference.

In another exemplary embodiment of the present invention, long portions 34 and 44 of fins 30 and 40 may operate in the opposite sides (i.e., left side and right side) individually with respect to centerline 10 as shown in FIGS. 9(A) and 9(B).

However, as shown in FIGS. 9(A) and (B), while the long portions 34 and 44 of fins 30 and 40 may operate in opposite sides respectively with respect to the centerline of the watercraft, the watercraft may tend to rotate by the reaction force of water applied to fins 30 and 40 in front thereof. Accordingly, the rudder 5 may be steered by the controller 60 to counteract the rotation of the watercraft.

Hereinafter, a link mechanism and a rack and pinion to control fins 30 and 40 of wake modifying system in an exemplary embodiment of the present invention will be explained.

Figure 5:
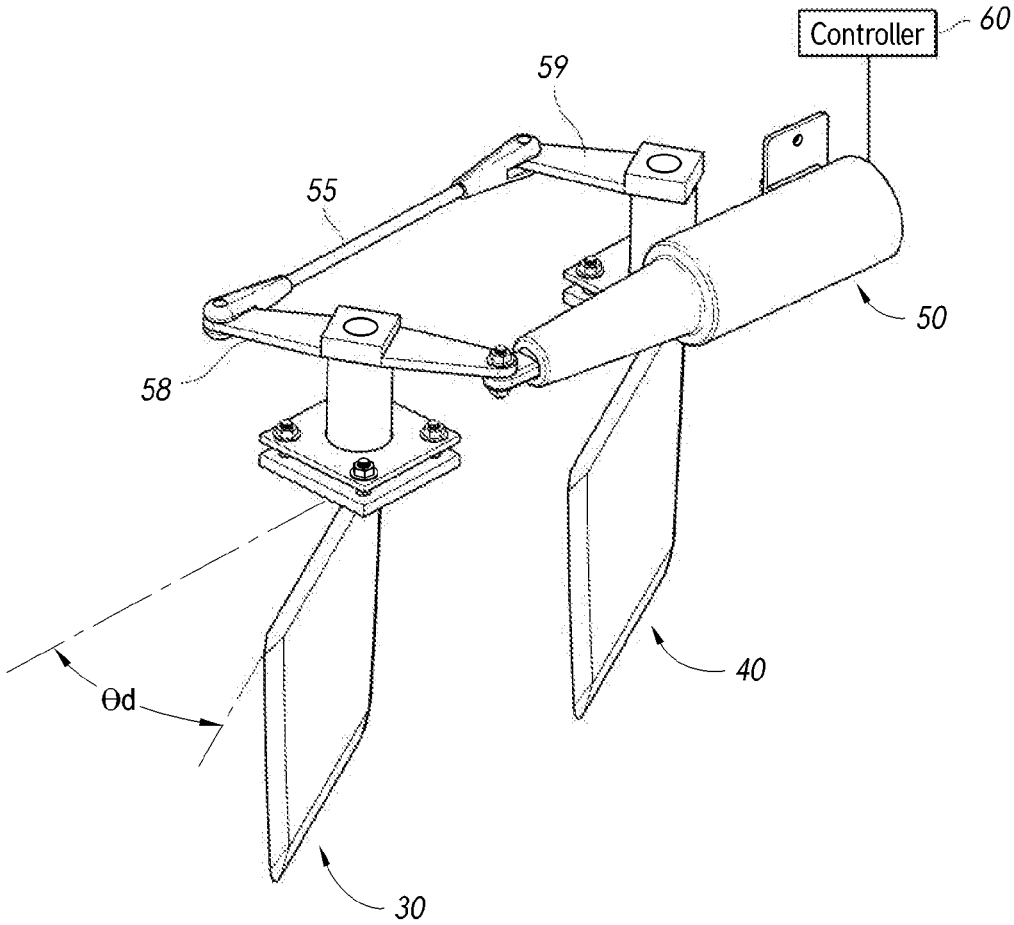
FIG. 5 is an enlarged schematic view of the actuator and two fins of FIG. 1 wherein the two fins are tilted with a predetermined angle with respect to the centerline.
Figure 10:
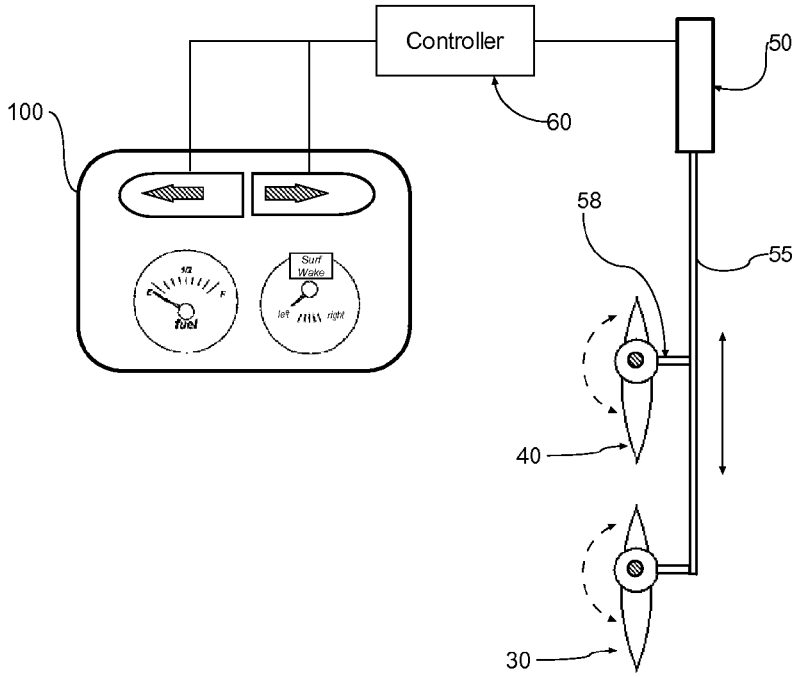
FIG. 10 is a schematic view illustrating two fins coupled to an actuator via a link mechanism according to an exemplary embodiment of the present invention.

FIGS. 3, 5, and 10 are a schematic view illustrating two fins coupled to an actuator via a link mechanism according to an exemplary embodiment of the present invention.

The link mechanism may include arms 58 and 59 which are fixed to fins 30 and 40 wherein an end of each arm 58 or 59 is pivotally coupled to a connecting rod 55.

In various embodiments, as shown in FIGS. 3 and 5, one end of actuator 50 may be affixed to the watercraft and another end thereof is operably coupled to another end of one of the arms 58 and 59 such that actuator 50 can synchronously pivot fins 30 and 40 relative to centerline 10.

In various embodiments, another end of actuator 50 may be fixed to one end of the connecting rod 55 and disposed in parallel as shown in FIG. 9 such that actuator 50 can synchronously pivot fins 30 and 40 relative to centerline 10.

Figure 11:
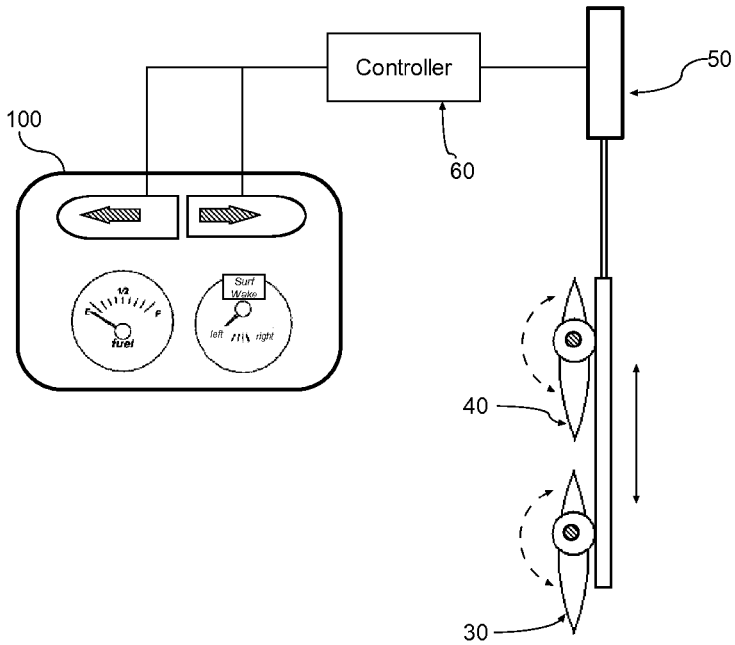
FIG. 11 is a schematic view illustrating two fins coupled to an actuator via a rack and pinion according to an exemplary embodiment of the present invention.

FIG. 11 is a schematic view illustrating two fins coupled to an actuator via a rack and pinion according to an exemplary embodiment of the present invention.

Here, one end of actuator 50 may be affixed to the watercraft and another end thereof is operably coupled to a rack 70 which is meshed to pinions 75 formed adjacent to the upright axis 36 and 46 of each fin 30 and 40 as shown in FIG. 11.

The wake modifying system, as an exemplary embodiment of the present invention, may further include a display device having touch screen 100. In this structure, the operator may provide a control signal to the controller 60 by touching the touch screen 100 to control the rotation angle of fins 30 and 40. One will also appreciate that otherwise conventional switches (e.g., mechanical, electronic, electromechanical, etc.) or other suitable means may be used to translate the drivers input to suitable controls.

Hereinafter, the operation of wake modifying system in an exemplary embodiment of the present invention will explained with reference to FIGS. 6(A) and (B).

As shown in FIG. 6(A), fins 30 and 40 extend in their neutral position substantially along center line 10. If a right side surf wake is desired, surf fins 30 and 40 may be turned to the left to a desired angle θd, as shown in solid lines in FIG. 6(B). Such leftward alignment of the fins will cause the watercraft to turn towards the left. In order to compensate, the driver must actively turn the watercraft to the right, for example, steer to the right to overcome the effects of fins 30 and 40 of pulling the boat to the left. In order for the watercraft to ultimately travel straight, rudder 5 angles to the left as the driver steers right, as shown in FIG. 6(B), which causes the watercraft to lean right such that the right aft corner sinks into the water (in much the same manner as the watercraft would if the it were performing a conventional right turn.

One will appreciate that, if a left surf wake is desired, the fins and rudder would be turned in the opposing direction (e.g., as the fins are shown in phantom in FIG. 6(B). This would require steering left to compensate, thus causing the water craft to lean left and effecting a left surf wake.

As noted above, and with continued reference to FIG. 6(B), fins 30 and 40 (as shown in solid lines) cause the watercraft to turn to the left. To compensate for this tendency to turn left, the driver must steer the watercraft to the right in order to track a straight path (e.g., parallel to centerline 10). Steering to the right causes rudder 5 to angle left and extend in substantially the same direction as fins 30 and 40, and in some cases, extend substantially parallel to the fins. Such alignment of fins and rudder may direct or channel more water to the right side of the watercraft, which may serve to further enhance a right surf wake.

Such enhancement may result in creating a suitable wake for surfing with less overall lean of the watercraft. For example, using conventional ballast methods, a significant amount of weight would be positioned one side of the stern which would effect a 14° lean to the desired side. In contrast, using the fins of the present invention may effect a suitable wake with as little as 5° lean toward the desired side. Such reduced lean may facilitate control of the water craft, and provide passengers on the water craft a more enjoyable ride.

One will also appreciate that the configuration of the present invention allows the driver to switch from a right surf wake to a left surf wake "on-the-fly". In particular, the driver may simply switch the fins from the solid line position of FIG. 6(B) to the phantom line position of FIG. 6(B), even while the watercraft is in motion, even if the watercraft is at speed.

When a speed of the watercraft is above a predetermined speed, the controller 60 may be configured to control actuator 50 to rotate the long portion 34 and 44 of each or both of fins 30 and 40 to approximately 0° relative to centerline 10. Accordingly, the watercraft may travel with fewer wakes. The predetermined speed may be approximately 10 miles per hour.

However, when the operator of the watercraft may create a large wake, he may provide control signal to the controller 60 via the touch screen 100, and then the controller 60 regulates actuator 50 to pivot fins 30 and 40 to the desired angle θd.

Since fins 30 and 40 are aligned with a predetermined angle with respect to the movement direction of the watercraft, the water facing the bow 2 of the watercraft creates reaction force to fins 30 and 40. Accordingly, the bow 2 is yawed into the water.

In this structure, bow of the watercraft biased into the water is further submerged into the water such that larger wakes are effectively created by the body of the watercraft.

In an exemplary embodiment of the present invention, the maximum angle is approximately 22 degrees.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

The invention claimed is:

1. A boat configured to produce a first wake when traveling through water and configured to produce a second wake different from said first wake when a wake surfer is surfing said second wake behind said boat; the boat comprising:

a hull;

an operator control;

at least one wake modifier oriented substantially vertically, wherein, when the boat is in said water, said wake modifier is oriented substantially perpendicular to a surface of said water;

an actuator operably coupled to said wake modifier wherein actuation of said actuator moves said wake modifier between a first position and a second position, wherein one of said first position and said second position comprises said wake modifier being in a neutral position and the other of said first and said second position comprises said wake modifier being in an engaged position to form said second wake, said second wake comprising one of a left side surf wake or a right side surf wake different from said left side surf wake;

a rudder configured to track said boat in a straight line through said water when said boat is traveling at least at a speed suitable for surfing with said water diverter in said engaged position; and an electronic controller configured to regulate said actuator responsive to electronic signals received by said electronic controller from said operator control, said electronic signals responsive to input into said operator control by an operator.

2. The boat of claim 1, wherein said at least one wake modifier comprises first and second wake modifiers;

said actuator comprises first and second actuators;

said controller being configured to regulate each of said first and second actuators; and said operator using said operator control can switch said first and second wake modifiers from said right side surf wake to said left side surf wake while the boat is moving through the water at a predetermined speed, said predetermined speed being greater than stationary.

3. The boat of claim 2, wherein said predetermined speed comprises a speed suitable for surfing.

4. The boat of claim 1, wherein when said at least one wake modifier is in the engaged position to allow said wake surfer to surf said second wake and said second wake forms said left side surf wake, said rudder is responsive to said operator control to steer said hull left to compensate for a tendency of the hull to track right in order to track said hull in a straight path as said boat travels through said water.

5. The boat of claim 1, wherein said actuator is responsive to move said at least one wake modifier to said neutral position when said boat travels through said water above a predetermined speed.

6. The boat of claim 1, wherein said at least one wake modifier comprises a first and second wake modifier and said operator control comprises an electronic surf left control for said left side surf wake and an electronic surf right control for said right side surf wake, and wherein single actuation of said surf left control causes at least said first wake modifier to move to the engaged position and wherein single actuation of said surf right control causes said at least said second wake modifier to move to the engaged position.

7. The boat of claim 6, wherein said first wake modifier and said second wake modifier individually move.

8. The boat of claim 6, wherein said first wake modifier and said second wake modifier cooperatively move.

9. The boat of claim 1, wherein said substantially vertical orientation comprises a somewhat inclined orientation.

10. The boat of claim 1, wherein said at least one wake modifier comprises a fin.

11. The boat of claim 6, wherein said engaged position comprises a fully engaged position.

12. A method of producing a surfing wake when a boat is configured for surfing as said boat travels through water, said surfing wake being different from a wake when said boat is configured for not surfing as said boat travels through water, the configuration of said boat from surfing to not surfing responsive to input to an electronic control, said method comprising:

receiving input responsive to a selection of a right side surf wake; and actuating an actuator responsive to a controller to move a substantially vertically oriented wake modifier from a first position to a second position, wherein one of said first position and said second position comprises said wake modifier being in a neutral position and the other of said first and said second position comprises said wake modifier being in an engaged position to form said surfing wake, said surfing wake comprising a right side surf wake different from a left side surf wake.

13. The method of claim 12, wherein said substantially vertically oriented wake modifier comprises a somewhat inclined wake modifier and wherein said actuating comprises actuating said actuator to move said somewhat inclined wake modifier.

14. The method of claim 12, wherein said wake modifier comprises a fin and wherein said actuating comprises actuating said actuator to move said fin.

15. The method of claim 12, wherein said receiving input comprises receiving single actuation input responsive to a selection of the right side surf wake.

16. The method of claim 12, comprising:

receiving input responsive to a selection of a left side surf wake; and actuating an actuator responsive to a controller to move a second substantially vertically oriented wake modifier from a first position to a second position, wherein one of said first position and said second position of said second wake modifier comprises said second wake modifier being in a neutral position and the other of said first and said second position comprises said second wake modifier being in an engaged position to form said surfing wake, said surfing wake comprising said left side surf wake.

17. A surf boat comprising:

a hull;

a rudder;

a plurality of wake modifiers oriented substantially perpendicular to a surface of said water when said hull is in said water, said plurality of wake modifiers each having a deployed position and a neutral position, wherein when in said deployed position and said hull is moving through said water, at least one of said plurality of said wake modifiers modifying a wake of said hull to produce either a right side surf wake or a left side surf wake different from said right side surf wake; and an operator control including a right surf control and a left surf control, wherein selection of said right surf control causes at least one of said plurality of said wake modifiers to produce said right side surf wake and selection of said left surf control causes at least one of said plurality of said wake modifiers to produce said left surf wake.

18. The surf boat of claim 17, wherein said plurality of wake modifiers comprise fins.

19. The surf boat of claim 17, wherein the operator control is responsive to single actuation of one of said right surf control and said left surf control.

20. The method of claim 12, comprising tracking with a rudder said boat in a straight line through said water when said boat is traveling at least at a speed suitable for surfing with said water diverter in said engaged position.

* * * * *

UNITED STATES PATENT AND TRADEMARK OFFICE

CERTIFICATE OF CORRECTION

PATENT NO. : 8,534,214 B1
APPLICATION NO. : 13/830274
DATED : September 17, 2013
INVENTOR(S) : Daniel Lee Gasper It is certified that error appears in the above-identified patent and that said Letters Patent is hereby corrected as shown below:

In the Claims

In Column 9, Line 3, in Claim 17, change "of said water" to --of water--.

Signed and Sealed this
Fifteenth Day of October, 2013

Teresa Stanek Rea

Teresa Stanek Rea
*Deputy Director of the United States Patent and Trademark Office*